United States Patent [19]

Sasaki et al.

[11] Patent Number: 5,076,567

[45] Date of Patent: Dec. 31, 1991

[54] MEDIUM TRANSFERRING SYSTEM

[75] Inventors: Naoya Sasaki, Ibaraki; Masataka Kawauchi, Ishioka, both of Japan

[73] Assignee: Hitachi, Ltd., Tokyo, Japan

[21] Appl. No.: 526,694

[22] Filed: May 21, 1990

Related U.S. Application Data

[63] Continuation of Ser. No. 207,523, Jun. 16, 1988, abandoned.

[30] Foreign Application Priority Data

Jun. 17, 1987 [JP] Japan ..... 62-148994
Dec. 18, 1987 [JP] Japan ..... 62-318879

[51] Int. Cl.[5] ..... B65H 7/14
[52] U.S. Cl. ..... 271/265; 271/111
[58] Field of Search ..... 271/98, 110, 111, 265

[56] References Cited

U.S. PATENT DOCUMENTS 4,030,722 6/1977 Irvine ..... 271/111 X
4,310,153 1/1982 Kikuchi ..... 271/111 X
4,331,328 5/1982 Fasig ..... 271/111 X
4,787,620 11/1988 Goldkuhle ..... 271/111

FOREIGN PATENT DOCUMENTS 6241553 9/1985 Japan .
60171950 3/1987 Japan .
8501478 4/1985 PCT Int'l Appl. .

*Primary Examiner*—Richard A. Schacher
*Attorney, Agent, or Firm*—Antonelli, Terry, Stout & Kraus

[57] ABSTRACT

A medium transferring apparatus which makes use of a preliminary transference stage prior to a main transference stage at the time of transference of a medium such as a sheet of paper. In the former stage, an initial parameter setting operation is performed so that a desired amount of feeding of the medium and control parameters for achieving this feed amount, including the amount of control rotation, rotational speed and acceleration on starting of a transferring motor are automatically determined on the basis of external factors used as parameters such as the number of operations of the transferring apparatus, the type of the medium and desired environmental factors of use of the apparatus including temperature and humidity. In the initial parameter setting operation, an unknown friction coefficient of the medium is determined. In the main transference stage, data thereby obtained enables the medium to be transferred with constant accuracy no matter what the thickness, difference in level, friction coefficient of the medium, as well as environmental factors.

5 Claims, 13 Drawing Sheets

FIG. 4

| $Wi_{(gf)}$ \ $t_{(mm)}$ | 0 | 1 | 1.5 | 2.0 |
|---|---|---|---|---|
| 50 | 0 | 5 | 7 | |
| 100 | 0 | 8 | | |
| 150 | | 11 | | |
| 200 | | | | |
| | | | | |

FIG. 17

| $\Delta X_{mm}$ \ P% | 10 | 20 | 30 | 40 |
|---|---|---|---|---|
| 0.01 | 0.45 | 0.45 | 0.44 | — |
| 0.02 | 0.90 | — | — | — |
| 0.03 | 1.35 | — | — | — |
| 0.04 | — | — | — | — |

FIG. 18

| $\Delta X_{mm}$ \ n | 10 | 20 | 30 | 4 |
|---|---|---|---|---|
| 0.01 | 0.4 | 0.41 | 0.41 | 0.4 |
| 0.02 | 0.8 | 0.82 | 0.82 | |
| 0.03 | 0.12 | — | — | — |
| 0.04 | 0.16 | — | — | — |
| | 0.20 | | | |

FIG. 19

| PAGE \ n | 10 | 20 | 30 | 40 |
|---|---|---|---|---|
| 1 | $V_0$ | $V_2$ | $V_3$ | — |
| 2 | $V_0$ | — | — | — |
| 3 | $V_1$ | — | — | — |
| 4 | — | — | — | — |

FIG. 20

| LINE \ P% | 10 | 20 | 30 | 40 |
|---|---|---|---|---|
| 1 | $V_3$ | $V_3$ | $V_4$ | — |
| 2 | $V_5$ | $V_6$ | — | — |
| 3 | $V_5$ | — | — | — |
| 4 | — | — | — | — |

MEDIUM TRANSFERRING SYSTEM

This application is a continuation of application Ser. No. 207,523, filed June 16, 1988, now abandoned.

BACKGROUND OF THE INVENTION

1. Field of the Invention

This invention relates generally to medium transferring systems and, more particularly, to a medium transferring system suitable for transferring with accuracy sheets of paper, such as bank notes, bank books or slips used in bank terminal equipment, or recording paper used in a printer, using a transferring means such as rubber rollers.

2. Related Art

In an ordinary process of transferring sheets of paper, the paper feed amount and other factors are adjusted each time when the feeding operation is performed, because the feeding accuracy depends upon the number of transferring operations, the kind of paper sheet to be dealt with, and so forth. Also, in a known system such as the one disclosed in Japanese Utility Model Unexamined Publication No. 62-41553, one of a plurality of modes predetermined on the basis of the thickness and the number of sheets to be transferred is selected with respect to one of the various types of media actually used, and the torque of a paper feeding motor is changed in accordance with the selected mode.

In this conventional art, the mode most suitable for each type of paper sheet is selected from a plurality of modes predetermined on the basis of the thickness and number of sheets, and the transferring torque is controlled on the basis of the selected mode. This system, however, fails to consider that the coefficients of friction between the paper sheet and transferring rollers are different in dependence on the types of paper sheet, which is one of the predominant factors in regard to changes in transference accuracy. This method is therefore defective in terms of the need to maintain a high degree of transference accuracy. In particular, there is a problem of spoiling due to character-printing deviations or of stain due to slippage in the process of transferring a bankbook in bank terminal equipment or transferring recording paper in a printer. There is another known system, such as the one disclosed in Japanese Patent Unexamined Publication No. 60-171950, in which a circuit designed to generate a rapid start signal so as to increase the rate at which the speed of a drive motor rises when the motor starts is provided in order to reduce the time lag associated with the rise in speed of a recording medium at the time of starting of feeding of the recording medium.

In the above-described conventional art, there are several items to be adjusted with respect to the transference of sheets of paper, e.g., one of relating to changes in the friction coefficient with different types of paper or with different number of transferring operations, or one relating to variations in the feed amount due to changes in humidity. Thus, a great deal of trouble is involved in regard to adjustment. Also, in the case of performing an operation to reduce the noises and the vibrations resulting from the rapid starting of the transferring of the medium and to shorten the time lag on starting, the variation of the amount of slippage influenced by the factors such as the change of the environmental values such as humidity and the reduction of the coefficient of friction of transferring means such as rubber rollers and the like due to increase of the numbers of operation becomes large, so that it is difficult to adjust the amount of the slippage. In the prior art, adequate consideration has not been taken to the above-described case and it is difficult to maintain a high degree of accuracy of the transferring.

SUMMARY OF THE INVENTION

It is therefore an object of the present invention to provide a medium transferring system which is capable of achieving feed amounts with the same degree of accuracy no matter what the thickness, differences in surface level and friction coefficient of the medium sheet due to the inclusion in the system of an initial parameter setting operation conducted before main operation for the purpose of automatically determining parameters of control in respect of a medium transferring motor, and thereby estimating and determining an unknown friction coefficient of the medium.

It is another object of the present invention to provide a maintenance-free medium transferring system capable of performing accurate transference of a medium by automatically detecting the state of the medium and factors by preliminary storing factors such an environmental factor mentioned above as humidity, the number of transference operations and the thickness of the medium and data such as the feed amount relative to the factors, number of rotation, speed of rotation and acceleration on starting of the transferring motor for achieving the feed amount in memory as data tables.

The present invention provides in one of its aspects a medium transferring system having: an operational section which previously stores, as a parameter, a variable component of a pressing force of a transferring means relative to the thickness of a medium to be transferred, and determines the friction coefficient of the medium on the basis of the amount of slippage of the medium measured in a preliminary transference stage prior to the main transference stage with an equation of motion representing transference of the medium, and determines a parameter of control of a paper feeding motor to form a transference speed pattern in order to achieve the desired amount of slippage during transference; a coefficient memory section for storing this control parameter; and a data memory section for storing the amount of slippage.

The operational section for determining a control parameter of the paper feeding motor determines the value of the parameter in accordance with various types of medium in such a manner that the amount of feeding becomes constant with respect to all the different types of medium. Data on the control parameter which are stored in the coefficient memory section are supplied one by one to the motor driving section, thereby enabling the medium to be transferred with constant accuracy irrespective of the type thereof.

The present invention provides in another of its aspects a medium transferring system which has: a data memory section capable of continuously storing and updating groups of data on the amount of control rotation, rotational speed and acceleration on starting of a transferring motor for achieving a desired feed amount in accordance with external factors used as parameters, including an environmental factor such as humidity, the number of operations, the types of mediums; an input section for inputting the data into the data memory section; a discriminating section for taking up data; and a sensor section for supplying information for discrimination; and which is maintenance-free and capable of transferring the medium with accuracy while suitably controlling the transferring motor by automatically learning the amount of control of the transferring motor in accordance with external factors on the basis of data thereon.

BRIEF DESCRIPTION OF THE DRAWINGS

FIG. 4 is a schematic diagram of an example of contents of a data memory section;

FIGS. 17 to 20 are schematic diagrams of contents of data tables shown in FIG. 15.

DESCRIPTION OF THE PREFERRED EMBODIMENTS

An embodiment of the present invention will be described below with reference to FIGS. 1 to 4.

Figure 1:
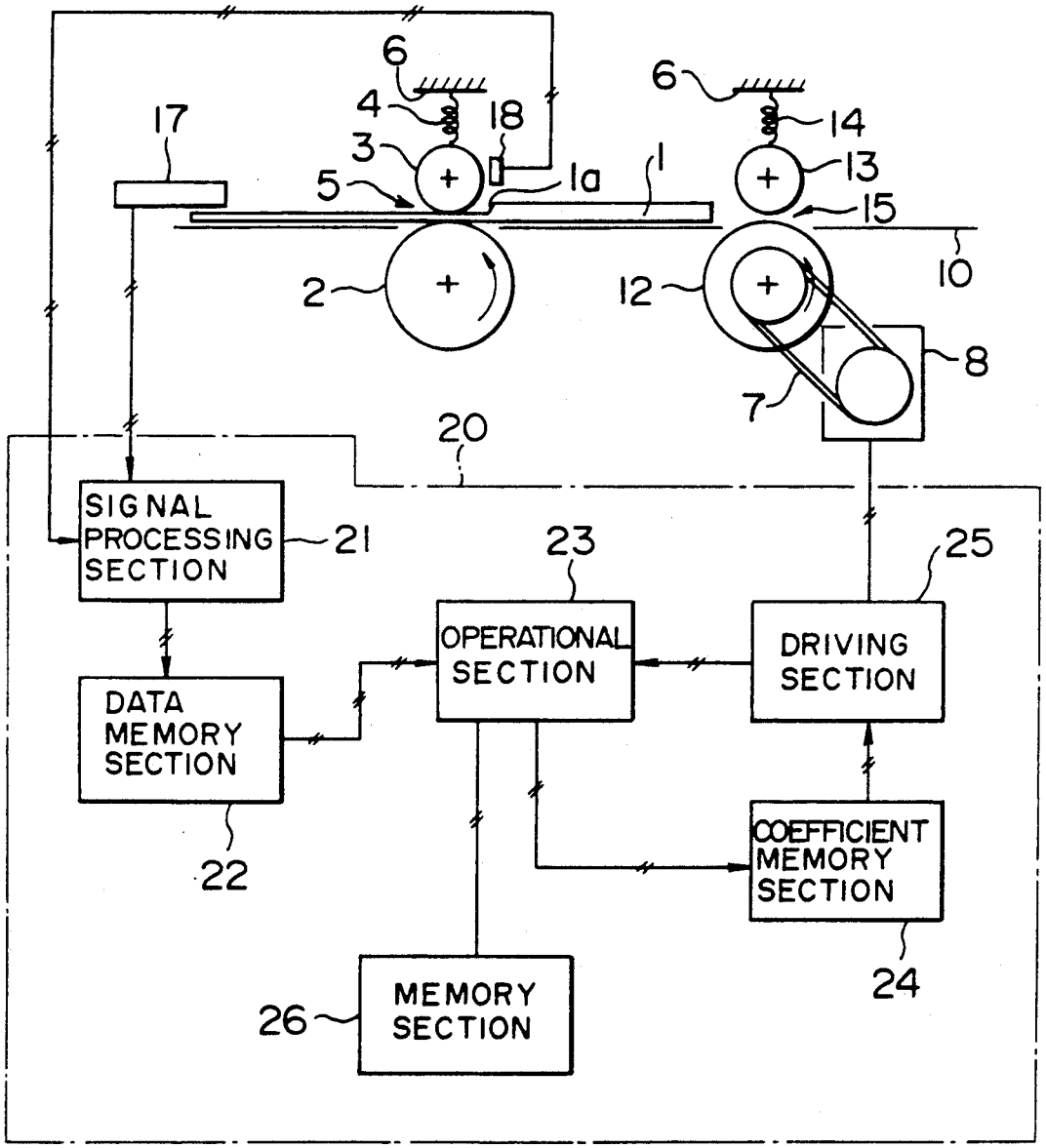
FIG. 1 is a diagram of an arrangement of an embodiment of the present invention.

FIG. 1 shows an essential portion of a system for transferring a bankbook in an apparatus for printing characters on bankbooks which represents an embodiment of the present invention.

A bankbook 1 which is a medium to be transferred is transferred, over a guide plate 10 provided as a member for guiding the medium, by a first transferring means 5 and a second transferring means 15 placed at a desired distance from the first transferring means 5.

The first transferring means 5 has a first driving roller 2 and a first driven roller 3 facing the first driving roller 2. The second transferring means 15 has a second driving roller 12 and a second driven roller 13 facing the second driving roller 12. Each of the rollers 2, 3, 12 and 13 is a roller having a surface of a high friction coefficient such as rubber roller. The first and second driven rollers 3 and 13 are supported by support members 4 and 14 such as springs each of which is fixed at its one end to a stationary frame 6. With this arrangement, the first driving roller 2 and the second driven roller 3, as well as the second driving roller 12 and the second driven roller 13 transfer the bankbook 1 while pinching the same in the vertical direction as viewed in FIG. 1. During transference, the first driven roller 3 and the second driven roller 13 freely move in the vertical direction by following changes in the level of the surface or in the thickness of the bankbook 1 by virtue of the support members.

A pulse motor 8 provided as a driving means is connected to the second driving roller 12 via a belt 7 provided as a transfer mechanism. The arrangement is such that the first driving roller 2 and the second driving roller 12 are driven at the same speed in synchronization with each other by a transfer mechanism constituted by belts or gears (not shown). Otherwise, it is possible that the first driving roller 2 and the second driving roller 12 are independently connected to driving motors and the speeds of these motors are controlled so that the rollers are rotated at the same speed in synchronization with each other.

The first sensor 17 is adapted to detect the position of a leading end of the bankbook 1 when characters are printed on the bankbook 1. The sensor 17 detects the displacement of the leading end of the bankbook 1 from the reference position or amount of slippage when the bankbook 1 is stopped.

A line sensor, for example, is used to constitute the first sensor 17. A second sensor 18 is provided in the vicinity of the first driven roller 3 between the first transferring means 5 and the second transferring means 15. The second sensor 18 is adapted to detect a state in which the a seam 1*a* of the bankbook 1 is pinched between the first driving roller 2 and the first driven roller 3. The second sensor 18 may be an optical sensor.

A control unit 20 is designed to control the operation of the pulse motor 8. The control unit 20 is constituted by a signal processing section 21 for processing signals supplied from the first sensor 17 and the second sensor 18, a data memory section 22 for storing data supplied from the signal processing section 21, an operational section 23 for performing a calculation on the basis of various signals, a coefficient memory section 24 for storing the results of calculation performed by the operational section 23, a driving section 25 for controlling the operation of the pulse motor 8 by using data stored in the coefficient memory section 24, and a memory section 26 for previously storing, in a table, data on the correlation between the thickness of the medium and a difference $\Delta W$ between a pressing force and a transferring force, and data on the positional relationship between the first driven roller 3 and a stepped portion of the bankbook 1. In a preliminary transference step before a main transference step, the amount of slippage with respect to various types of mediums are measured by means of the first sensor 17, the second sensor 18 and the control unit 20. The various types of mediums can be transferred at the same rate on the basis of the amounts of slippage measured in this preliminary step.

The operation in the preliminary transference step will first be described with reference to FIGS. 1 and 2. This operation will be exemplified with respect to a case in which a single slip and a bankbook on any pages are transferred through the same transference path.

In a first step, a reference medium among mediums to be transferred is assigned. In this case, a single slip is selected.

After the reference medium has been assigned, transference of the reference medium through a transference path shown in FIG. 1 is carried out.

By the transference of the reference medium, a constant in an equation 1 which represents the motion of the reference medium, namely, in this case, a friction coefficient $\mu_1$ of the reference medium is determined (step A).

Next, a method of determining the friction coefficient $\mu_1$ will be described.

In general, when a medium having a mass $m_1$ is transferred with a certain speed pattern $V_1$ by rubber rollers or the like, an amount of feed or slippage $x_1$ of the medium is represented by $$\frac{d^2x_1}{d^2} = f(\mu_1, w_1, m_1, F_1) - \frac{1}{m_1} \cdot \frac{dV_1}{dt} \quad (1)$$

where $m_1$ represents the mass of the medium, $w_1$ a pressing force of the driven roller at the time of transference, and $F_1$ a resisting force of the medium in a direction of transference.

In the operation of step A, the speed pattern $V_1$ is set to be variable, the medium is transferred with respect to each speed pattern, and the amounts of slippage $x_1$ of the medium at the time of this transference is measured. As a result, the friction coefficient $\mu_1$ is estimated therefrom by using equation 1. Data on other parameters $m_1$, $w_1$ and $F_1$ are previously stored as a data base in the memory section 26. Data from this data base are successively referred to and calculations based thereon are performed by the operational section 23, thereby obtaining the friction coefficient $\mu_1$.

A distribution of the amount of slippage $x_1$ at this time is stored in the data memory section 22 (step B), and control parameters of the pulse motor 8 for achieving the speed pattern at this time are stored in the coefficient memory section 24 (step C).

Next, the bankbook is transferred and a friction coefficient $\mu_2$ is obtained in a manner similar to that in the case of the single slip selected as a reference medium while an arbitrary number of pages is turned (step D).

In this case, for comparison with the single slip, the bankbook is transferred while being opened at an intermediate page.

An amount of slippage $x_2$ of the bankbook in this state is represented by an equation similar to equation 1:

$$\frac{d^2x_2}{dt^2} = f(\mu_2, w_1 + \Delta w_2, m_2, F_2) - \frac{1}{m_2} \cdot \frac{dV_2}{dt} \quad (2)$$

$$(w_2 = w_1 + \Delta w_2)$$

where $m_2$ represents the mass of an intermediate page of the bankbook, $w_2$ a pressing force of the driven roller at the time of transference, and $F_2$ a resisting force of the bankbook in a direction of transference.

In equation 2, unknowns are $\mu_2$ and $\Delta w_2$. The thickness of the bankbook varies in contrast with the case of transference of the single slip. Correspondingly, the pressing force of the transferring roller varies. The above $\Delta w_2$ represents this variation.

Data thereon is previously stored in the memory section 26. $\Delta w_2$ is obtained from this data.

The friction coefficient $\mu_2$ is estimated by the amount of slippage $x_2$ that is measured in a manner similar to that in the case of step A by making the speed pattern $V_2$ variable.

A distribution of the amount of slippage $x_2$ at this time is stored in the data memory section 22 (step E), and control parameters of the pulse motor 8 for achieving the speed pattern at this time are stored in the coefficient memory section 24 (step F).

Thereafter, friction coefficients $\mu_3$, $\mu_4$, . . . of the bankbook measured by successively turning the pages of the bankbook are estimated in the same manner.

Thus, the process of estimating friction coefficients $\mu_1$, $\mu_2$, . . . of the bankbook with respect to arbitrary numbers of turned pages is completed.

Next, a transference speed $V_i$ relating to amount of slippage $x_i$ with respect to each page is obtained (step H).

Since the friction coefficient $\mu_2$ has already been obtained, the transference speed $V_i$ is represented by $$\frac{d^2x_i}{dt^2} = f(\mu_i, w_1 + \Delta w_i, m_2, F_i) - \frac{1}{m_2} \cdot \frac{dV_i}{dt} \quad (3)$$

In this equation, $\Delta w_i$ varies with respect to each page and each line. Data thereon is previously stored in the memory section 26, and parameters are determined on the basis of this data (step G).

At this point, the transference speed $V_i$ is changed as desired so that the right side of equation 1 and the left side of equation 1 become equal to each other. Control parameters of the pulse motor 8 which achieve the transference speed $V_i$ when these sides become equal to each other are stored in the coefficient patterns relating to states of transference with respect to all pages.

All control operations described above with reference to the flowchart of FIG. 2 are performed by the operational section 23.

Figure 3:
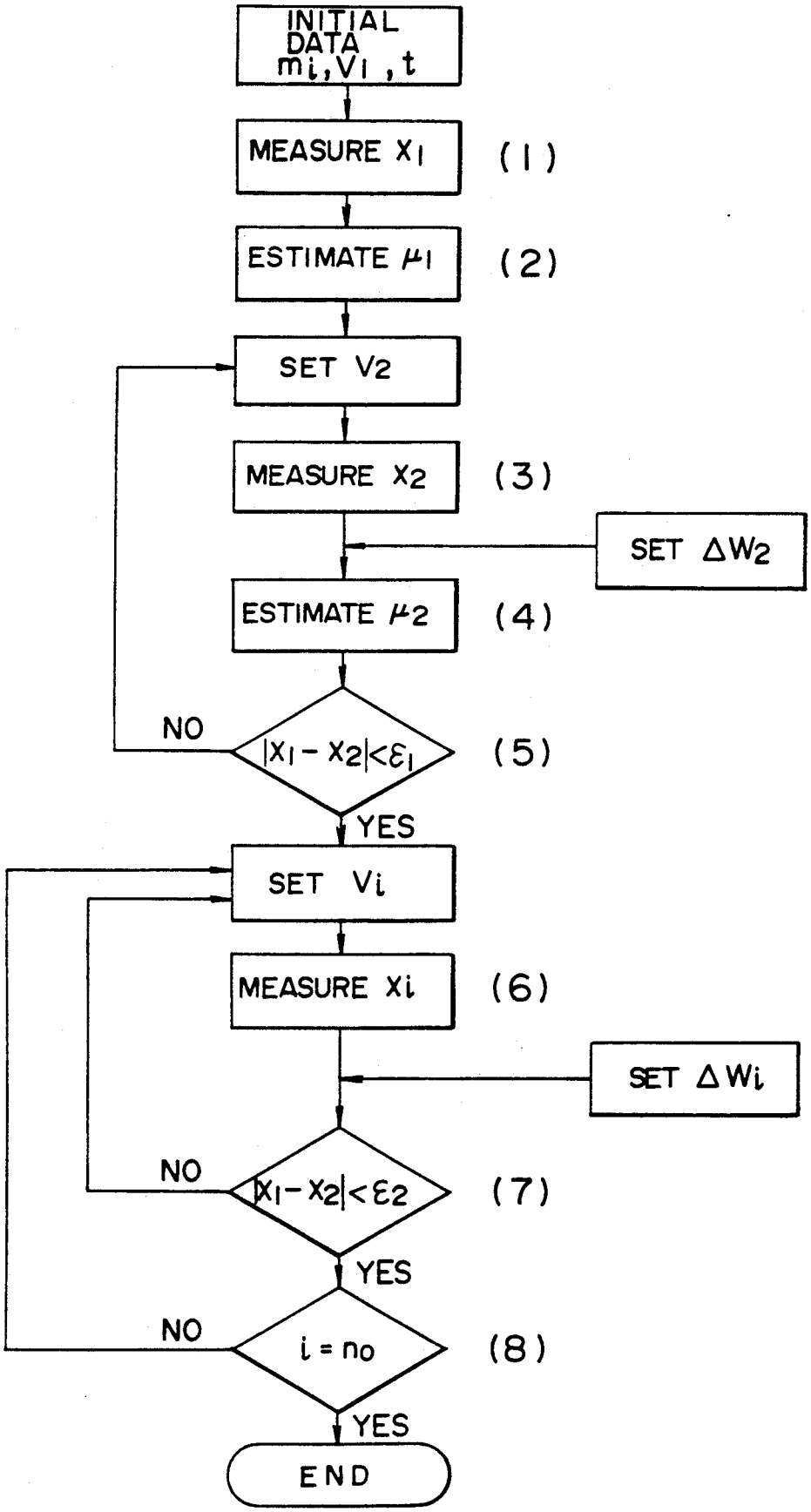
FIG. 3 is a flowchart of determination algorithm of an operation section in accordance with the present invention.

FIG. 3 shows a flowchart of an algorithm carried out by the operational section 23.

During the operation using the reference medium, the amount of slippage is measured on the basis of initial data $m_1$, $V_1$, t (step 1), and the friction coefficient $\mu_1$ of the transference surface of the reference medium is estimated by using equation 1 (step 2). Then, the bankbook is set, and the amount of slippage $x_2$ is measured while the transference speed pattern $V_2$ is changed, with respect to a state in which the bankbook is opened at a central page (step 3). The friction coefficient $\mu_2$ is estimated by using equation 2 (step 4). This estimation is performed with setting of the variable component $\Delta w_2$ of the pressing force in correspondence with the thickness of the pages of the opened bankbook. The amount of slippage $x_1$ at the time of transference of the reference medium and the amount of slippage $x_2$ are compared with each other by utilizing the determined friction coefficient $\mu_2$ (step 5). The transference speed pattern $V_2$ is successively changed until the difference between these amount of slippage becomes smaller than a certain minute set value $\epsilon_1$. The amount of slippage x at the time when the difference becomes below the set value $\epsilon_1$ is stored in a predetermined area. At this time, the variable component $\Delta w_2$ of the pressing force relating to the thickness t of the transferred medium opened at the central page is obtained from a data table such as that shown in FIG. 4.

Similarly, the amount of slippage $x_i$ at the time of transference of the bankbook with respect to page i is measured while the transference pattern $V_i$ is changed (step 6), and the amount of slippage $x_1$ and the amount of slippage $x_i$ are compared with each other by using equation 3 (step 7). The transference pattern $V_i$ is determined so that the difference between these amount of slippage becomes smaller than a certain minute set value $\epsilon_2$. When control parameters of the pulse motor which achieve $V_i$ with respect to all pages are determined (step 8), the operation of determining transference control parameters for the paper feeding motor in the operational section 23 is completed.

After control parameters of the pulse motor 8 for achieving $V_i$ with respect to all pages have been determined in the above-described manner, and after they have been stored in the coefficient memory section 24, the system proceeds to the main transference stage. In the main transference stage, the bankbook 1 is transferred by the first and second transferring means 5 and 15 while being guided by the guide plate 10.

At this time, the thickness of the bankbook 1 is detected by the second sensor 18, an amount of slippage is obtained by the operational section 23 in the control unit 20 from the friction coefficient, pressing force, and so forth, and control parameters corresponding to this amount of slippage are determined from values stored in the coefficient memory section 24. The gain of the motor, for example, is included in these control parameters. The operation of the pulse motor 8 is controlled on the basis of these control parameters. The transferred bankbook 1 is stopped in such a manner that a leading end thereof is always stopped at a predetermined desired position. Thus, the operation for determination of control parameters including the gain of the transferring motor is carried out before the system is actually operated, thereby achieving a constant amount of slippage with respect to any medium and enabling the medium to always stop at a certain position no matter what the type of the medium, even if the friction coefficient of the medium is unknown.

It is therefore for the apparatus for printing characters on the bankbook to always stop the bankbook at a predetermined position irrespective of a page at which the bankbook is opened, thereby eliminating the possibility of character-print deviations and, hence, stains due to slippage.

As described above, in accordance with the embodiment, a constant amount of feeding can be achieved with constant accuracy irrespective of the thickness, differences in level and friction coefficient of the medium transferred.

Figure 14:
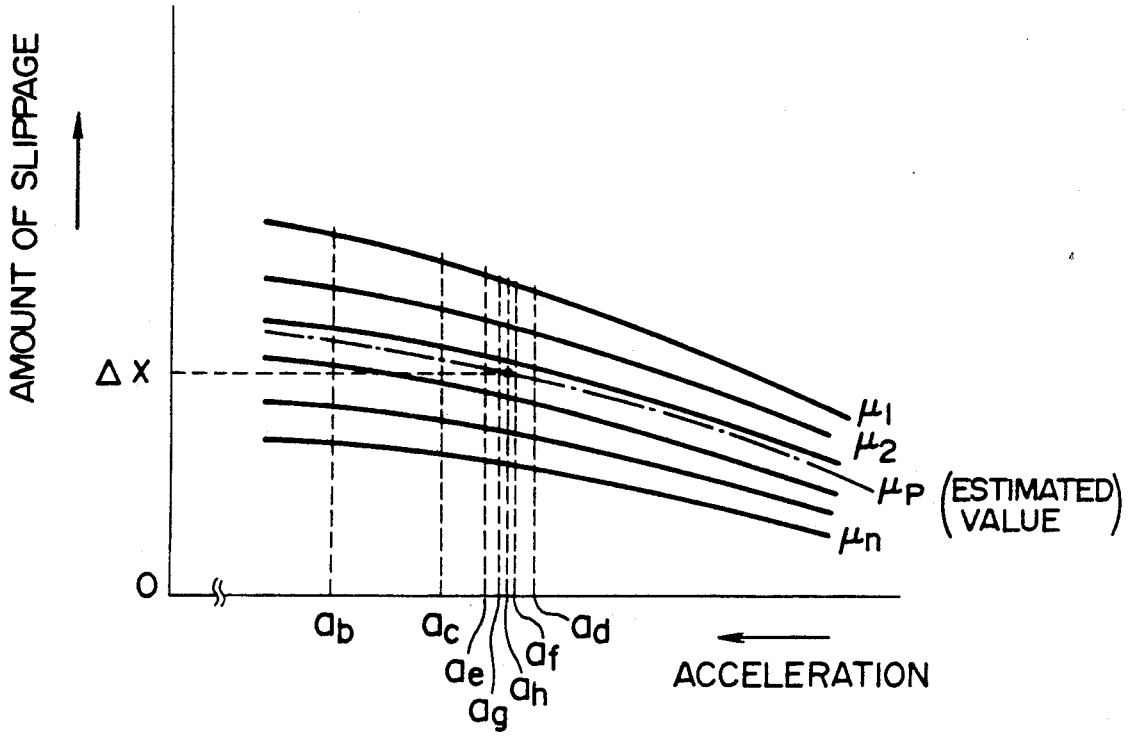
FIG. 14 is a graph of the relationship between an amount of slippage $\Delta S$ and a transference acceleration (a) with a friction coefficient $\mu$ provided as a parameter in accordance with the embodiment shown in FIG. 5.

The present invention will be described below with respect to another embodiment thereof with reference to FIGS. 5 and 14. In this embodiment, a plurality of sensors, e.g., two pairs of optical switches $17_{a1}$ and $17_{b1}$, $17_{a2}$ and $17_{b2}$ are used in place of the first sensor 17 of the embodiment shown in FIG. 1, and are disposed at desired intervals. The medium is transferred between the plurality of sensors in a certain predetermined order by using the transference acceleration along the transference path as a parameter, and the friction coefficient of the medium is determined on the basis of items of data stored in the data memory section and the amount of slippage measured from signals output from the plurality of sensors in response to on and off states thereof. Except for this feature, this embodiment is the same as the embodiment shown in FIG. 1.

FIGS. 6 to 13 show an example of a movement of the medium 1 based on an operational section algorithm in accordance with this embodiment. A medium 1 is first transferred through a section x defined by the pair of optical switches $17_{a1}$ and $17_{b1}$, $17_{a2}$ and $17_{b2}$ from a a starting point at the position of the optical switches $17_{a1}$ and $17_{b1}$ to a feed amount $x_0$ corresponding to the rotation of the transferring roller while the transference acceleration is used as a parameter. FIG. 14 shows the relationship between an amount of slippage $\Delta x$ and a transference acceleration (a) in accordance with this embodiment with a friction coefficient $\mu$ used as a parameter. This relationship is stored as a data base in the memory section 26.

Figure 6:
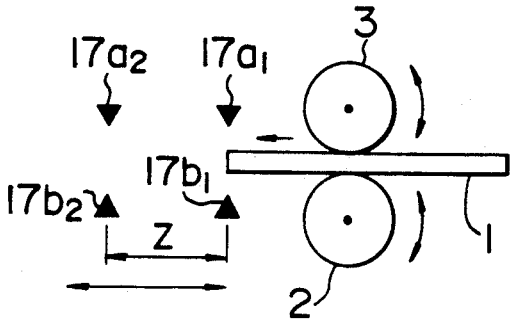
FIGS. 6 to 13 are diagrams of an example of movement of a medium in accordance with the algorithm of the operational section in the embodiment shown in FIG. 5.

Next, a process of estimation of the friction coefficient $\mu_1$ will be described. The medium 1 is inserted into the first transferring means 5 in the transference path and is pinched between the first driving roller 2 and the first driven roller 3, thereby being introduced into the first sensor section 17. The optical switches $17_{a1}$ and $17_{b1}$ and the optical switches $17_{a2}$ and $17_{b2}$ are thereby turned on or off, and the position of the medium 1 is obtained as described above, thereby stopping the leading end of the medium 1 at the optical switches $17_{a1}$ and $17_{b1}$. In this state, the optical switches $17_{a1}$ and $17_{b1}$ are in the on state while the optical switches $17_{a2}$ and $17_{b2}$ are in the off state (as shown in FIG. 6). Thereafter, a speed pattern with an acceleration represented by a transference acceleration $a_b$ and a deceleration gentle enough to present occurrence of slippage between the medium 1 and the rollers is generated in response to an instruction from the driving section 25 so that slippage occurs in the acceleration range only, thereby transferring the medium 1 to a position Z corresponding to the feed amount $x_0$.

Figure 7:
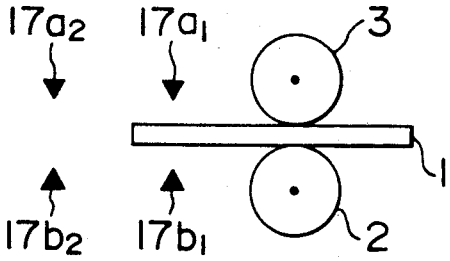
Figure 8:
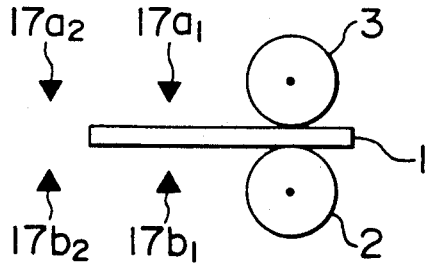
Figure 9:
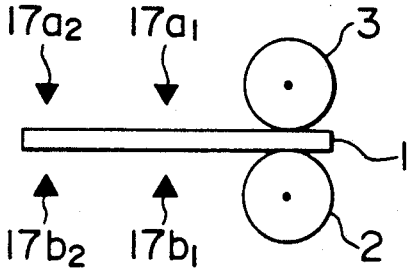

If the medium 1 is transferred at the transference acceleration $a_b$, the amount of slippage is so large that the leading end of the medium 1 does not reach the position Z, and that the optical switches $17_{a2}$ and $17_{b2}$ are in the off state (as shown in FIG. 7). As the transference operation proceeds from this state, the transference acceleration a is gradually decreased and is set to $a_c$ and to $a_d$. In this example of transference, the transferring roller is rotated in the opposite direction slowly enough to avoid slippage every transference step so that the leading end of the medium 1 returns to the position of the optical switches $17_{a1}$ and $17_{b1}$, and the medium is thereafter transferred from the same position at the next transference acceleration. When the transference acceleration is $a_c$, the amount of slippage becomes smaller than that exhibited when the transference acceleration is $a_b$, so that the medium approaches nearer to the position Z while the optical switches $17_{a2}$ and $17_{b2}$ are in the off state (as shown in FIG. 8). When the transference acceleration is $a_d$, the amount of slippage becomes much smaller, the medium approaches much nearer to the position Z, and the leading end of the medium 1 passes over the optical switches $17_{a2}$ and $17_{b2}$, thereby turning on the optical switches $17_{a2}$ and $17_{b2}$ (as shown in FIG. 9).

If the transference acceleration $a_d$ is a reference or a starting acceleration so that the acceleration at an n-th transference step is $a_n$, two algorithms are determined as follows. If the output from the optical switch $17_{a2}$ is changed over during the n-th transference operation, a set value $a_{n+1}$ of the n-th transference acceleration is represented by $$a_{n+1} = \frac{a_n + a_{n-1}}{2}$$

and, if the outputs from the optical switches $17_{a2}$ and $17_{b2}$ are not changed over, the set value $a_{n+1}$ of the transference acceleration is represented by $$a_{n+1} = \frac{a_n + a_{k-1}}{2}$$

where k represents the number of the transferring operation when the outputs from the optical switches $17_{a2}$ and $17_{b2}$ are finally changed over after the n-th transference operation. The transference acceleration $a_n$ corresponding to the time when $|a_{n+1}-a_n|$ becomes smaller than a certain small value $\epsilon$ is obtained.

Figure 10:
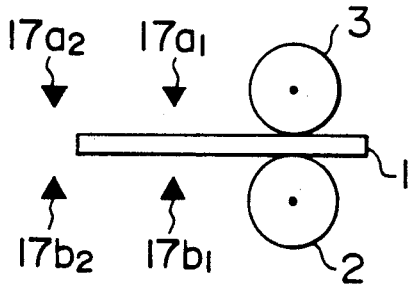

In accordance with these algorithms, with respect to the example of operation shown in FIGS. 6 to 13, the outputs from the optical switches $17_{a2}$ and $17_{b2}$ have been changed over during the progress of transference from a state in which the medium has been transferred at the transference acceleration $a_c$, as shown in FIG. 8, to a state in which the medium has been transferred at the transference acceleration $a_d$, as shown in FIG. 9. In the next transference step, therefore, the medium is transferred at a transference acceleration $a_3$ which is set to be greater than the transference acceleration $a_d$. The amount of slippage is thereby increased, the leading end of the medium 1 does not reach the optical switches $17_{a2}$ and $17_{b2}$, and the outputs from the optical switches $17_{a2}$ and $17_{b2}$ are changed over so that these switches are turned off (as shown in FIG. 10). In response to this change-over of the outputs from the optical switches $17_{a2}$ and $17_{b2}$, the next transference acceleration $a_f$ is as represented by $$a_f = \frac{a_c + a_d}{2}$$

Figure 11:
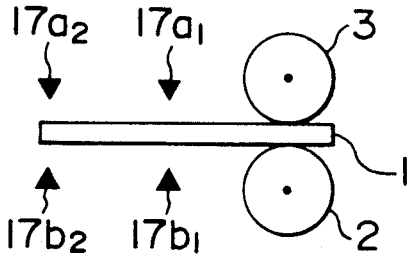
Figure 12:
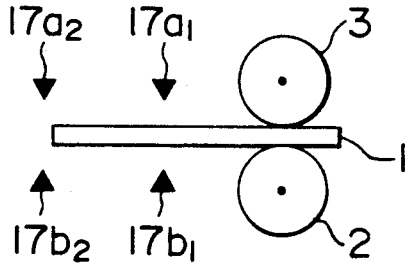
Figure 13:
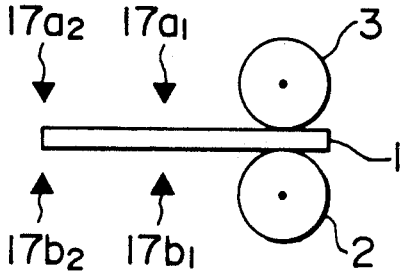

As these algorithms are repeated and the outputs from the optical switches $17_{a2}$ and $17_{b2}$ are successively changed over, the operation of transferring of the medium 1 proceeds to a state shown in FIG. 11 (in which the medium has been transferred at a transference acceleration $a_f$), to a state shown in FIG. 12 (in which the medium has been transferred at a transference acceleration $a_g$), and to a state shown in FIG. 13 (in which the medium has been transferred at a transference acceleration $a_h$), finally satisfying $|a_h-a_g|<\epsilon$. The transference acceleration $a_n$ is thus obtained. At this time, a friction coefficient $\mu_p$, which can be determined from the amount of slippage $\Delta x$ ($\Delta S_x=x_0-x$) and the transference acceleration $a_n$ on the basis of the data base expressed with the friction coefficient $\mu$ used as a parameter represented by equation 1, as shown in FIG. 14, can be used as an estimated value of the friction coefficient $\mu_1$.

All of the above-described operations are conducted in the operational section 23. Data on other parameters $m_1$, $w_1$, $F_1$ in equation 1 are previously stored as a data base in the memory section 26. Data from this data base are successively referred to and calculations based thereon are performed in the operational section 23, thereby obtaining the friction coefficient $\mu_1$.

Figure 2:
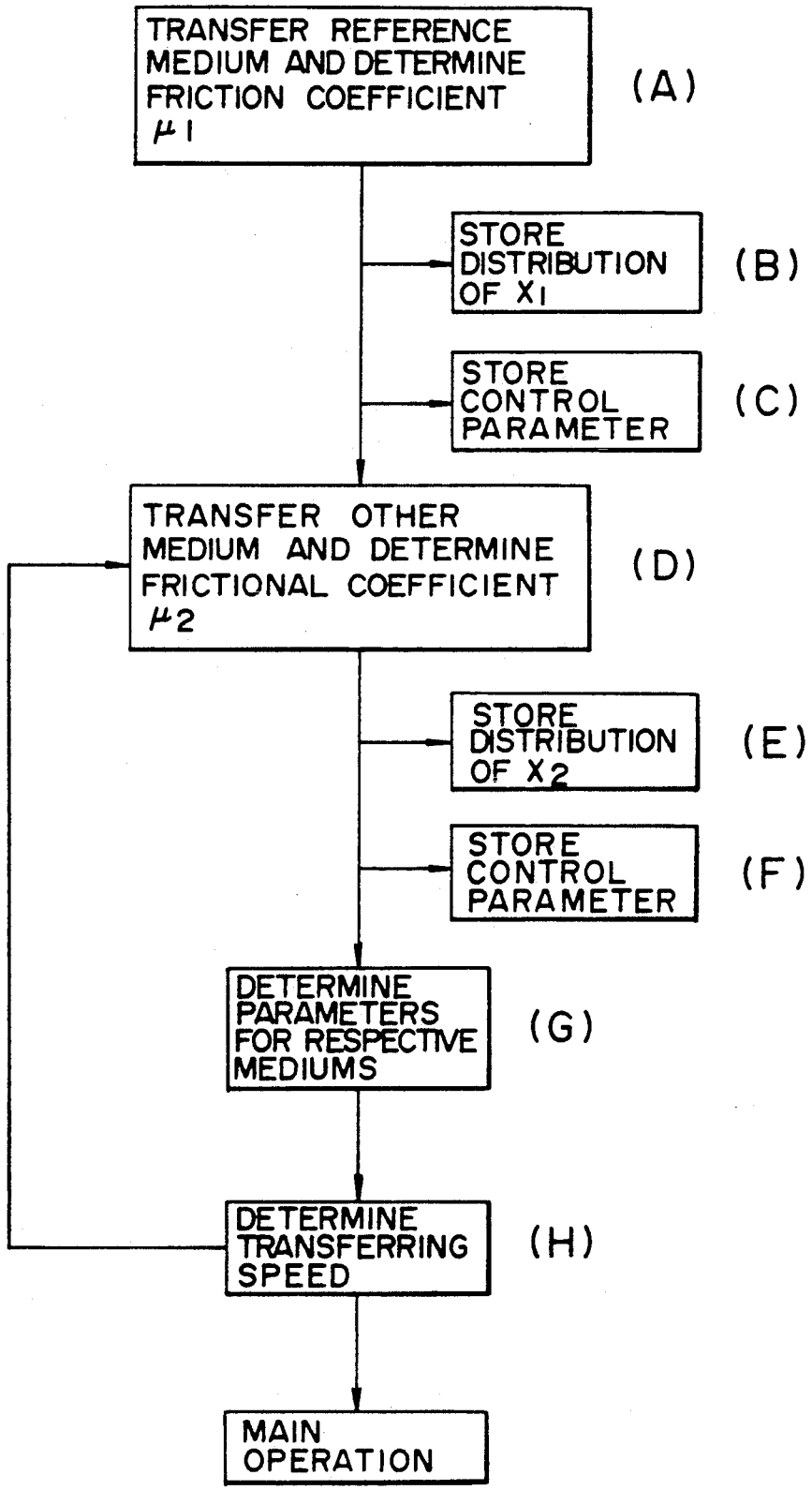
FIG. 2 is a flowchart of the procedure of operation at a preliminary transference stage in accordance with the present invention.

Thereafter, control parameters of the medium transferring motor are determined in accordance with the flowcharts shown in FIGS. 2 and 3, as in the case of the embodiment shown in FIG. 1, and the main transferring operation is then commenced.

Figure 5:
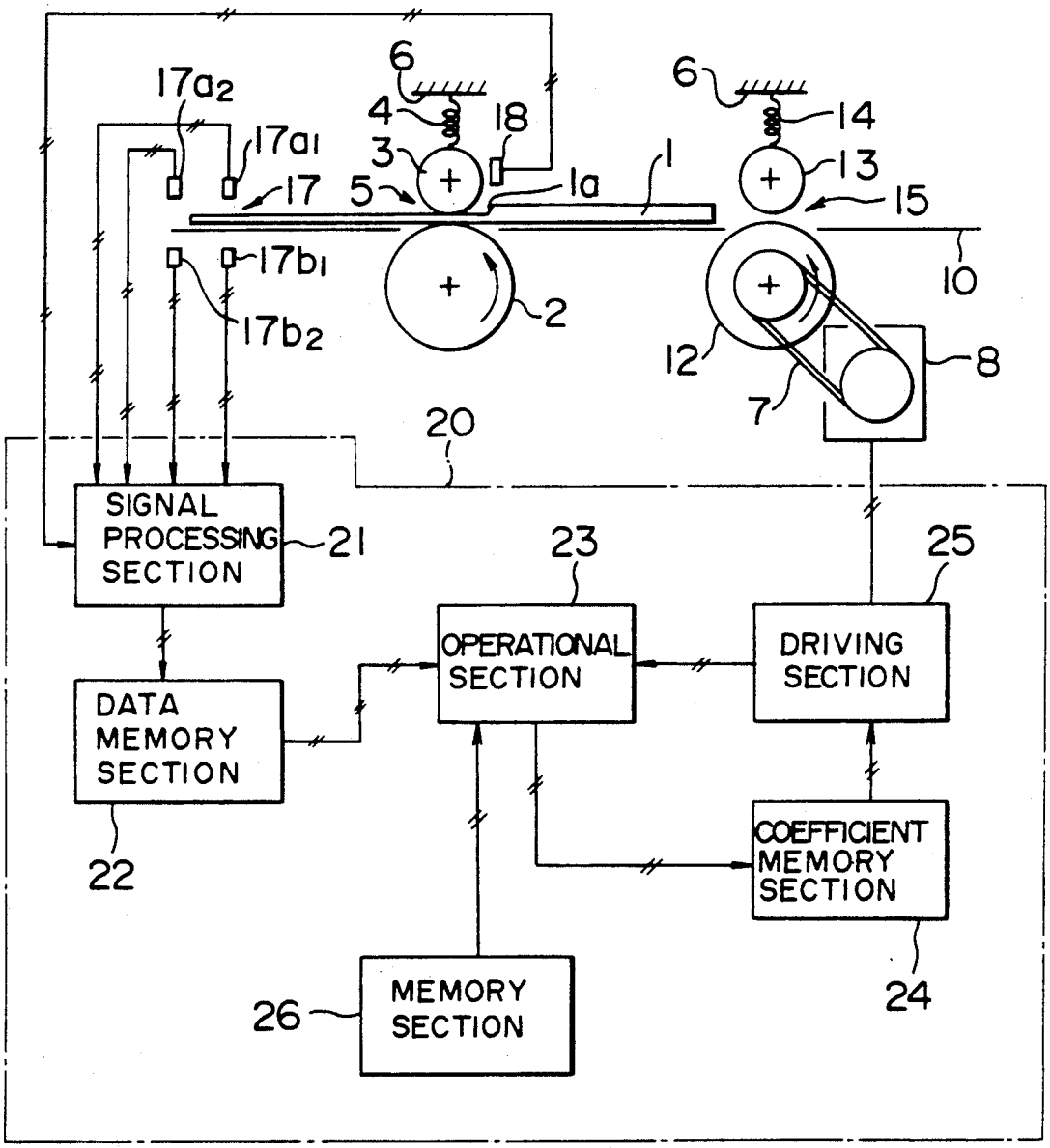
FIG. 5 is a diagram of an arrangement of another embodiment of the present invention.

As described above, in accordance with the embodiment shown in FIG. 5, the friction coefficient can be determined on the basis of the construction using a comparatively low-cost and simple sensor system.

Figure 15:
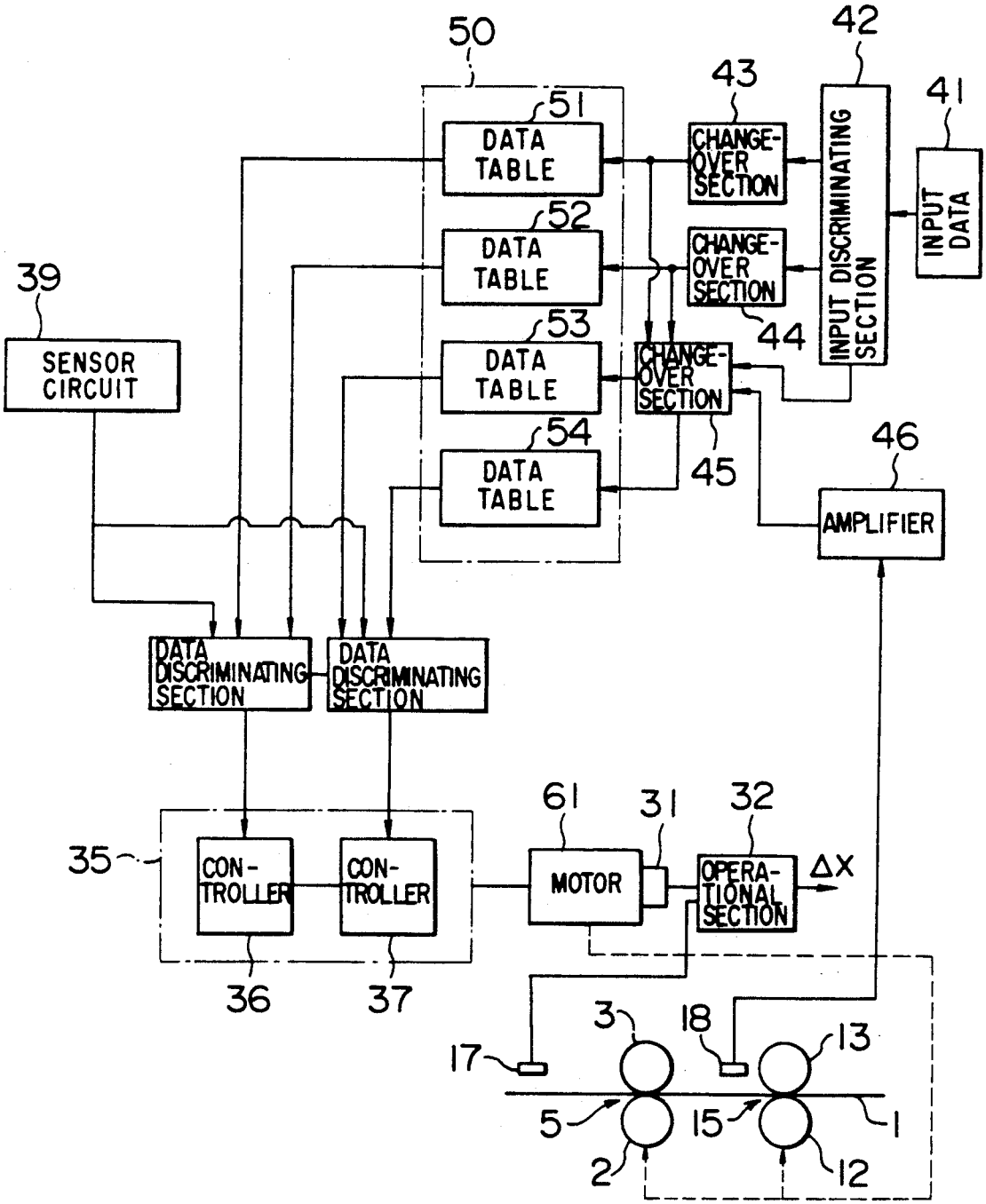
FIG. 15 is a diagram of an arrangement of still another embodiment of the present invention.

FIGS. 15 to 27 show still another embodiment of the present invention. FIG. 15 is a diagram of essential portions of a transferring structure adapted for transference of a medium such as a bankbook as in the case of the above-described embodiments.

Input data 41 on the degrees of influences or parameters including the type of the transferred medium (in this example, a bankbook), the humidity, the number of operations, and so forth are distributed as environmental factors to portions of a data memory section 50 via an input discriminating section 42 by means of change-over sections 43 and 44 adapted for, e.g., the humidity and the number of operations. The data memory section 50 is adapted to store data on the parameters relating to the transference of the bankbook, and has data tables 51, 52, 53 and 54. The data table 51 contains accumulated data on the amount of slippage $\Delta x$ (or feed amount x) with respect to the variations of humidity p, number of pages and lines of a bankbook provided as a medium to be transferred and amount (angle) of rotation $\beta$ of a transferring motor 61 for correcting the amount of slippage. The data table 52 contains accumulated data on the amount of slippage $\Delta x$ (or feed amount x) with respect to the variations of the number of operations n, number of pages and lines of a bankbook (namely, changes in the thickness of the bankbook and positional changes thereof) and amount (angle) of rotation $\beta$ of the transferring motor 61 for correcting the amount of slippage. The data table 53 contains accumulated data on transference speed V of the transferring motor for inhibiting the amount of slippage at each line of the bankbook relative to changes in the humidity p from exceeding an allowable value. The table 54 contains accumulated data on transference speed V for inhibiting the amount of slippage at each page of the bankbook relative to changes in the number of operations n from exceeding an allowable value.

The amount of slippage $\Delta x$ can be obtained by an operational section 32 on the basis of signals supplied from a first sensor 17 provided on the transference path and an encoder 31 provided for the motor 61. The amount of slippage $\Delta x$ is used as one of input data 41. Data discriminating sections 33 and 34 discriminate the supply of data in the data memory 50 to a motor drive control section 35 in response to signals supplied from a sensor circuit 39. The motor drive control section 35 has a controller 36 having functions of a memory and adapted to control the angle of rotation of the motor 61, and a controller 37 having functions of a memory and adapted to control the speed of the motor 61. A first transferring means 5 has a first driving roller 2 and a first driven roller 3, and a second transferring means 15 has a second driving roller 12 and a second driven roller 13. A bankbook provided as a transferred medium 1 is transferred by these means. The operation of the driving rollers 2 and 12 of these transferring means 5 and 15 is controlled by the motor drive control section 35. A second sensor 18 is adapted to detect the position of a difference in the level of the surface of the transferred medium 1 if the medium has a difference in thickness as in the case of a bankbook. The sensor 18 may be of an optical or magnetic type, or of a mechanical type. A signal output from the sensor 18 is amplified by an amplifier 46 and is thereafter applied to a change-over section 45.

The change-over section 45 is adapted to change over the operation of the data memory section 50 with respect to the update system of the data tables 53 and 54 between a real-time mode and a data formation mode.

The sensor circuit 39 has a function of storing data on the number of pages and number of lines of the bankbook provided as the transferred medium 1, and an environmental value such as humidity, and a function of counting the number of operations. In the described arrangement, the data memory section 50 has four data tables 51, 52, 53 and 54. However, it can be provided with another data table which contains accumulated starting acceleration values.

The operation of this embodiment will be described below with reference to FIGS. 15 to 27. FIGS. 17 to 20 schematically show examples of informations stored in the data memory section 50, and FIGS. 21 to 27 show examples of the relationship between parameters for forming the data tables.

Figure 16:
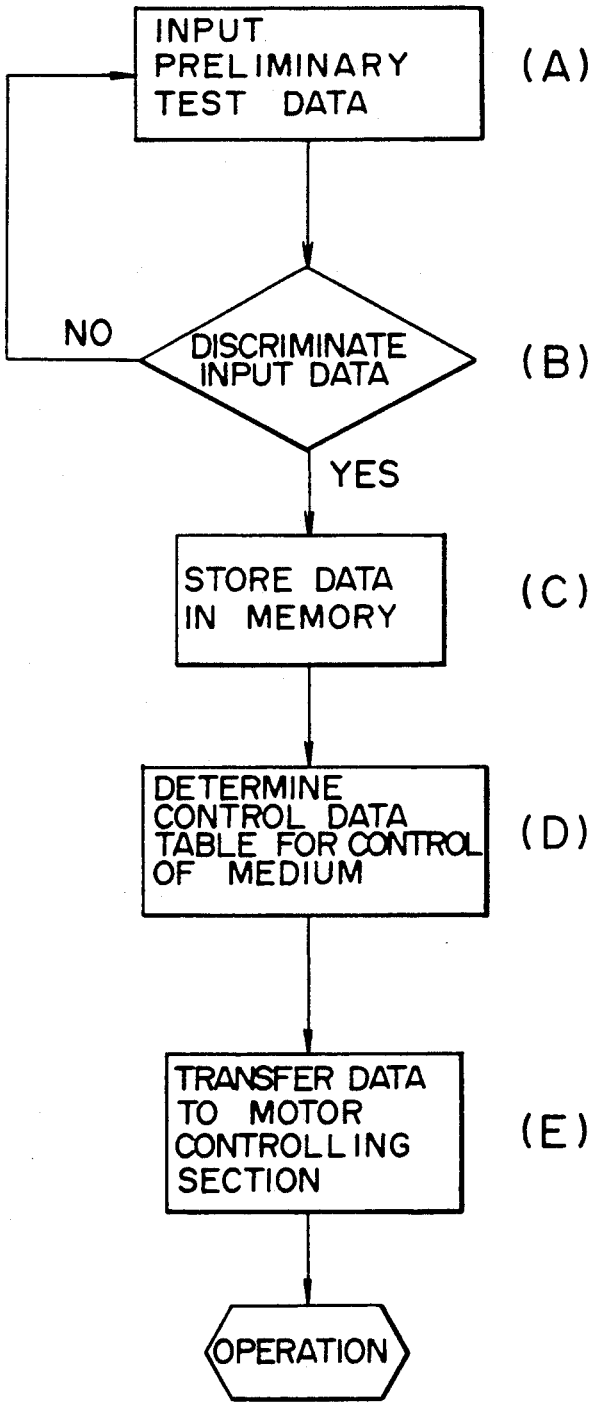
FIG. 16 is a flowchart of an operation means in accordance with the embodiment shown in FIG. 15.

The procedure of an entire operation will be described first with reference to FIGS. 15 and 16. Data 41 on the degrees of influences of parameters relative to the feed amount, including the humidity, the number of operations, the number of lines, and the number of pages, obtained when a preliminary test of the system for transferring the medium 1 or a bankbook, namely, preliminary transference is performed so as to evaluate the performance thereof by using a typical test paper, are previously input (step A), and are supplied to the input discriminating section 42, thereby discriminating the input data (step B). Data 41 thereby determined are distributed to and stored in the data tables 51, 52, 53 and 54 of the data memory section 50 by means of the change-over sections 43 and 44 automatically operated in response to the input data 41 (step C). After all of the data have been stored, corresponding control data are picked up from predetermined positions on the data memory by the data discrimination sections 33 and 34 on the basis of signals supplied form the sensor section 39, thereby determining a control data table with respect to the medium (step D). This table is supplied as signals to the drive control section 35 for controlling the motor 61 and is stored in memories thereof (step E). For instance, if the humidity p is 50% and the amount of feed is 10 mm, these items of information are automatically supplied to the discriminating sections 33 and 34 by the sensor circuit 39, so that an amount of slippage $\Delta x$ of 0.04 mm is obtained. It is then possible to assign, with respect to the condition that $\Delta x$ is 0.04 mm and the humidity is 50%, a suitable value of the angle of rotation $\theta$ of the motor and, if necessary, a value of the speed V thereof on the basis of the data tables shown in FIGS. 17 to 20.

To store data on a new medium in the data memory section 50, the new data may be added to the data previously stored in the data memory section 50, or it may be stored after the previously stored data has been cleared.

The data tables 53 and 54 of the data memory section 50 are not necessary in the case of transference of a type of medium such as a single slip or thin sheet of paper having a constant thickness, and the paper feed control is performed by using the data tables 51 and 52. In the case of a type of medium such as a bankbook which is transferred while changing its thickness over different pages, all of the data tables 51 to 54 are used to perform the paper feed control. In the case of a single slip or thin paper, the feed control is, basically, the positional control. In the case of a bankbook, both the positional control and the speed control are performed. However, the system is designed to enable, in some cases, both the positional and speed control with respect to a single slip or thin paper. The kind of control is selected in such a manner that change-over signal is issued on the basis of the discrimination effected by the input discriminating section 42 and is supplied to the change-over section 45.

The contents of the data tables 51 to 54 of the data memory section 50 are in the form of matrix, such as those schematically shown in FIGS. 17 to 20, of the angle of rotation $\theta$ of the transferring motor and the transference speed V with variable which are the amount of slippage $\Delta x$ and the respective parameters, namely, the humidity p and the number of operations n. Therefore, if values of the humidity p and the number of operations n are given, a corresponding angle of rotation $\theta$ and a corresponding transference speed V can be determined.

As mentioned above, FIG. 17 shows the content of the data table 51, and FIG. 18 the data table 52. Also, FIG. 19 shows a table of the allowable stable transference speed V with respect to each page of the bankbook contained in the table 53, and FIG. 20 shows a table of the allowable stable transference speed V with respect to each line of the bankbook contained in the data table 54. Data tables for respective lines are formed with respect to each page in correspondence with the number of pages.

The manner of determination of data in each data table will be described below with reference to FIGS. 21 to 27.

Figure 21:
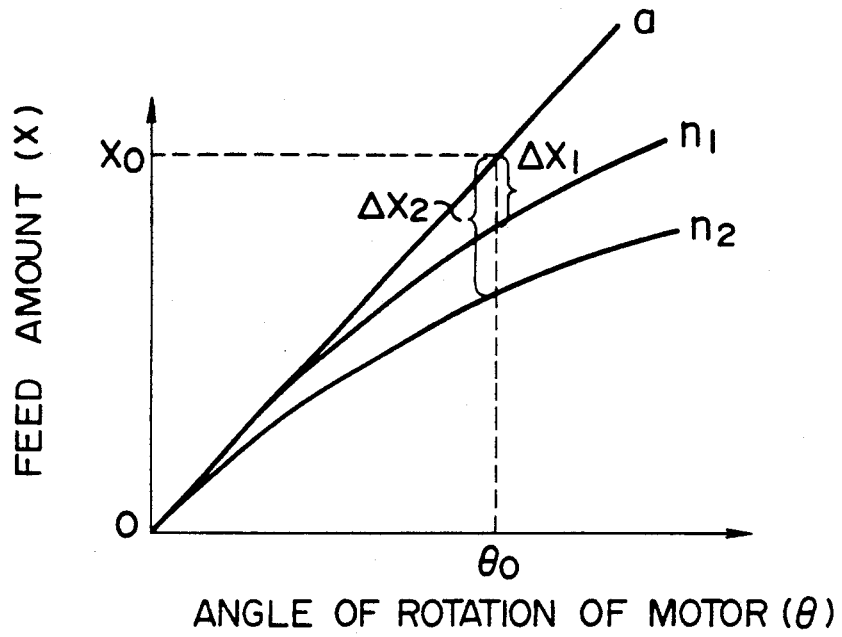
Figure 22:
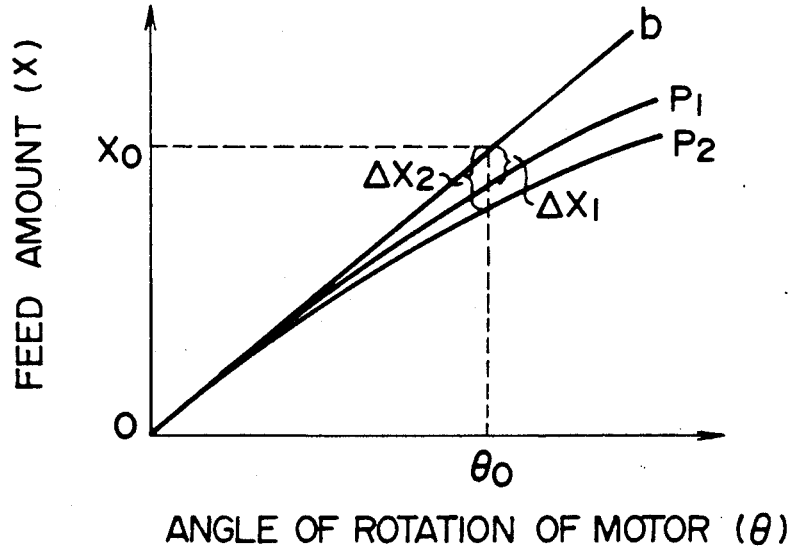

FIGS. 21 and 22 show examples of the relationship between the feed amount x relative to the number of operations n and the humidity p and the actual amount (angle) of rotation $\theta$ of the motor. FIG. 21 shows a relationship between the feed amount x relative to the numbers of operations $n_1$ and $n_2$ and the angle of rotation $\theta$ of the motor while FIG. 22 shows a relationship between the feed amount x relative to humidities $p_1$ and $p_2$ and the angle of rotation $\theta$ of the motor. In both cases, deviations $\Delta x_1$ and $\Delta x_2$ from the straight lines a and b of transference without slippage coincides with the amount of slippage $\Delta x$. Therefore, if the feed amount $x_0$ is determined, the relationship between the amount of slippage $\Delta x$ and the angle of rotation $\theta$ of the motor is correspondingly determined from the number of operations n and the humidity.

Figure 23:
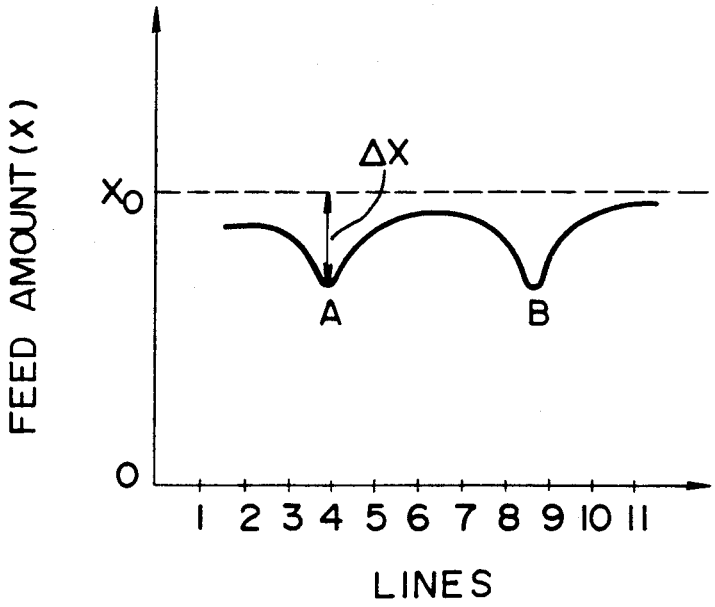
Figure 24:
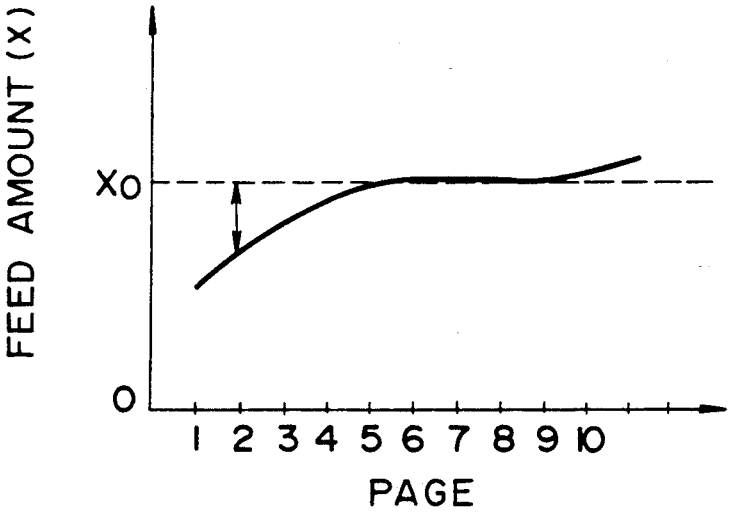
Figure 25:
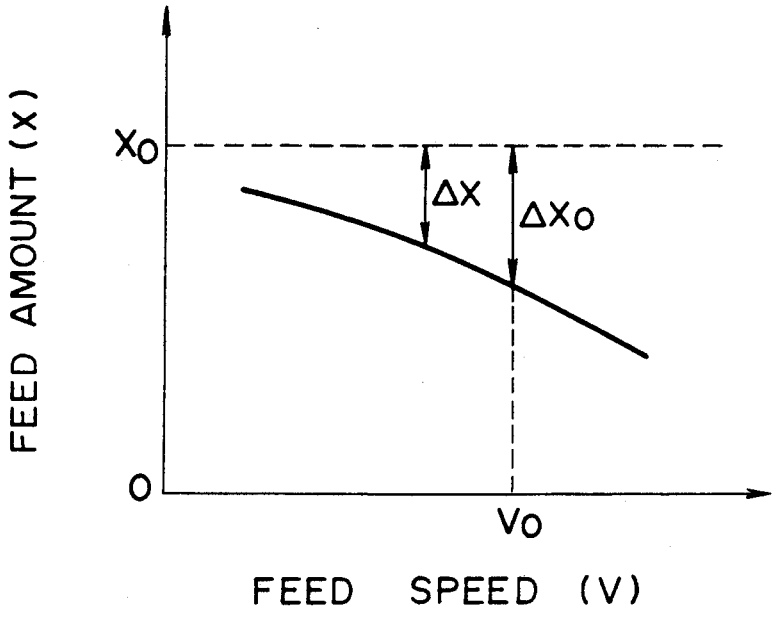
Figure 26:
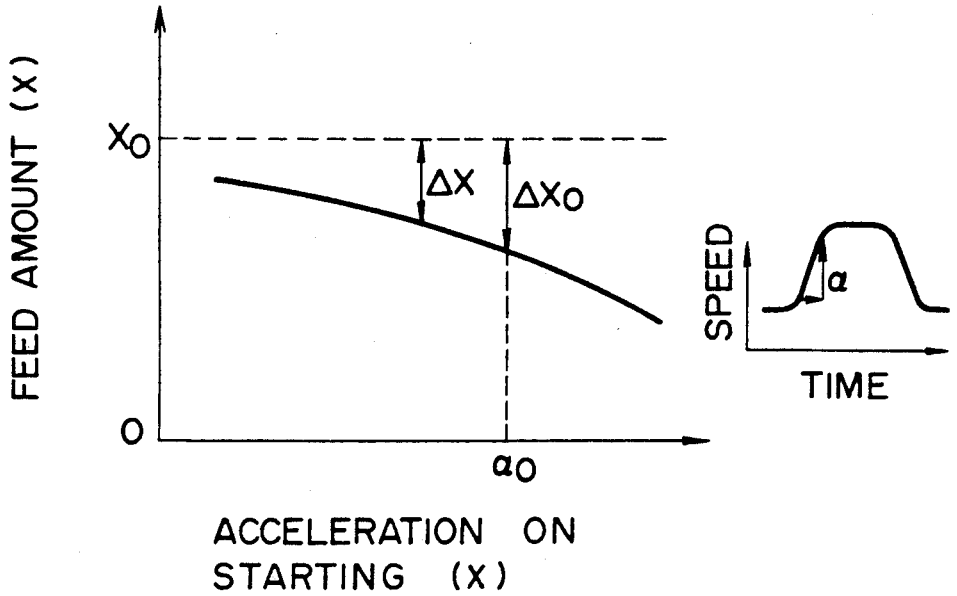

FIGS. 23 and 24 respectively show changes in the feed amount x with respect to lines and pages of the bankbook under a condition of a certain transference speed pattern, and FIGS. 25 and 26 show example of the relationship between the transference speed pattern and the feed amount x at a certain line and page.

Figure 27:
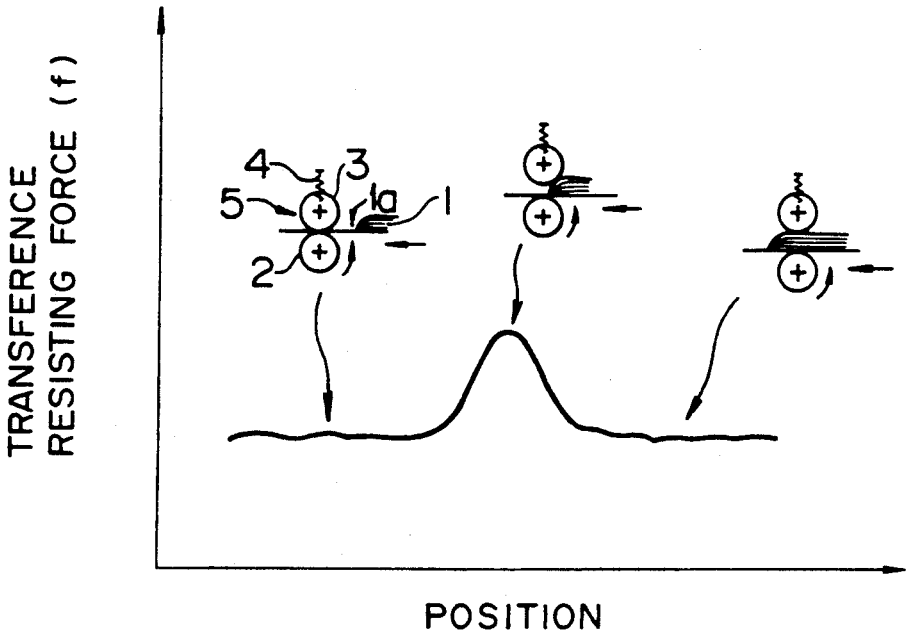
FIGS. 21 to 27 are graphs of determination of items of data in the data tables shown in FIG. 15.

FIG. 23 shows changes in the feed amount with respect different lines of the bankbook. The amount of slippage is specifically large at the points A and B. Increases at these points are caused by transference resisting force f when the seam la of the bankbook 1 enters the gap between the rollers 2 and 3 of the first transferring means 5, as shown in FIG. 27. It is therefore desired to set an allowable stable transference speed $V_0$ in order to prevent slippage, as shown in FIG. 25.

FIG. 24 shows changes in the feed amount with respect to different pages. In this case, the feed amount x differs at respective lines.

FIGS. 25 and 26 respectively show the relationship between the feed amount x and transference speed V and between the feed amount and starting acceleration at each page and each line. If, in this case, the allowable amount of slippage $\Delta x$ is determined, the allowable stable transference speed $V_0$ and an allowable stable starting acceleration $a_0$ are determined.

Therefore, matrix data in each of the data tables of the data memory section 50 shown in FIGS. 15 and 17 to 20 is formed from the data as shown in FIGS. 21 to 27, and the feed amount x can be controlled by the data.

In accordance with the above-described embodiments, data are stored in the transferring system at the test stage, namely, preliminary transference stage, and the system automatically learns information necessary for transference, specifically, information on influences of an environmental factor such as humidity and on the number of operations while continuously updating the information, the realizing a maintenance-free transferring system capable of operating with accuracy.

What is claimed is:

1. A medium transferring system for transferring mediums having different transference constants including friction coefficients comprising:

transferring means for transferring the mediums having the different transference constants; and control means for controlling the transferring means, the control means preliminarily determining drive control parameters for the transferring means including preliminarily determining a predetermined amount of slippage of the mediums in accordance with the different transference constants thereof utilizing the transferring means to preliminarily transfer the mediums and for storing the preliminarily determined drive control parameters, and controlling the drive of the transferring means for transferring subsequently presented ones of the mediums having the different transference constants in accordance with the stored preliminarily determined drive control parameters therefor.

2. A medium transferring system for transferring mediums comprising:

transferring means for transferring the mediums; and control means for controlling the transferring means, the control means preliminarily determining drive control parameters for the transferring means including means for preliminarily determining a transference constant including a friction coefficient for each of the mediums in accordance with a predetermined equation of motion for the mediums utilizing the transferring means to preliminarily transfer the mediums, means for storing the preliminarily determined transference constants, and means for determining and for storing the control parameters for the transferring means so as to enable an amount of slippage of each of the mediums to always be the same amount, and controlling the transferring means in accordance with the stored control parameters for transferring subsequently presented ones of the mediums so that the amount of slippage of each of the mediums transferred thereby is the same amount.

3. A medium transferring apparatus comprising:

transferring means for transferring mediums while guiding the medium by guide means;

first sensor means for detecting a forward end of each of the mediums when the mediums are stopped at a predetermined position and providing a signal indicative thereof;

second sensor means for detecting the thickness of the mediums being transferred and providing a signal indicative thereof;

drive means for driving the transferring means; and control means for controlling the drive means for driving the transferring means in accordance with signals supplied from the first and second sensor means and control parameters for the drive means preliminarily determined by utilizing the transferring means for preliminarily transferring the mediums so as to enable an amount of slippage of each of the mediums to always be the same amount.

4. A medium transferring apparatus comprising:

transferring means for transferring mediums while guiding the mediums by guide means;

first sensor means for detecting a forward end of each of the mediums when the mediums are stopped at a predetermined position;

second sensor means for detecting the thickness of the mediums being transferred;

control means for controlling the transferring means for preliminarily determining control parameters for a drive means of the transferring means utilizing the transferring means to preliminarily transfer the mediums so as to enable an amount of slippage of each of the mediums to always be the same amount, and for storing the preliminarily determined control parameters, and further including main transference stage control means responsive to the stored control parameters in the preliminary transference stage control means for controlling driving operations of the drive means for the transferring means in accordance with the stored control parameters.

5. A medium transferring apparatus comprising:

transferring means for transferring mediums;

control means for determining and storing control parameters of a drive means for the transferring means while utilizing the transferring means to preliminarily transfer the mediums so as to enable an amount of slippage of each of the mediums to become the same amount, and for controlling the driving operation of the drive means for the transferring means in accordance with the stored control parameters; said control means further including:

signal processing section means for processing signals relating to thickness of the mediums and to the position of a forward and of the mediums when the mediums are stopped;

data memory section means for storing data supplied from the signal processing section means, memory section means for preliminarily storing relationships between the thickness of the mediums and the transferring means, drive section means for controlling operation of the drive means;

operational section means for calculating control parameters from which an optimum speed pattern of the drive means is obtainable in accordance with the data supplied from the data memory section means and the memory section means;

coefficient memory section means for storing results of the calculation performed by the operational section means, wherein the mediums are transferred by the transferring means in accordance with control parameters selected according to the type of the mediums and the state of transference thereof from the control parameters stored in the coefficient memory section means.

* * * * *